US006607405B2

(12) United States Patent
Nishimura

(10) Patent No.: US 6,607,405 B2
(45) Date of Patent: Aug. 19, 2003

(54) MULTI-CARD CARD CONNECTOR FOR MULTI-TYPE CARDS

(75) Inventor: Takeshi Nishimura, Santa Clara, CA (US)

(73) Assignee: Yamaichi Electronics Co., Ltd., Tokyo (JP)

( * ) Notice: Subject to any disclaimer, the term of this patent is extended or adjusted under 35 U.S.C. 154(b) by 0 days.

(21) Appl. No.: 09/840,109

(22) Filed: Apr. 24, 2001

(65) Prior Publication Data

US 2002/0025726 A1 Feb. 28, 2002

(30) Foreign Application Priority Data

Apr. 27, 2000 (JP) ..... 2000-128489

(51) Int. Cl.[7] ..... H01R 24/00

(52) U.S. Cl. ..... 439/630; 439/541.5; 439/631; 439/83

(58) Field of Search ..... 439/630, 541.5, 439/631, 60, 924.1, 83

(56) References Cited

U.S. PATENT DOCUMENTS

| | | | | |
|---|---|---|---|---|
| 1,477,527 | A | 12/1923 | Raettig | |
| 3,040,291 | A | 6/1962 | Schweitzer et al. | 339/176 |
| 3,601,774 | A | 8/1971 | Stathos et al. | 339/176 |
| 3,631,381 | A | 12/1971 | Pittman | |
| 4,392,705 | A | 7/1983 | Andrews, Jr. et al. | |
| 4,507,697 | A | 3/1985 | Ozil et al. | |
| 4,734,041 | A | 3/1988 | Bruchmann | 439/637 |
| 5,401,185 | A | 3/1995 | Wang et al. | 439/441 |
| 5,716,221 | A | 2/1998 | Kantner | |
| 5,725,385 | A | 3/1998 | Takano et al. | |
| 5,904,597 | A | 5/1999 | Doi et al. | |
| 5,933,328 | A | 8/1999 | Wallace et al. | |
| 5,993,261 | A | 11/1999 | Klatt et al. | |
| 6,004,155 | A | 12/1999 | Wu | |
| 6,036,548 | A | 3/2000 | Braithwaite | 439/637 |
| 6,099,335 | A | 8/2000 | Chang | |
| 6,102,715 | A | 8/2000 | Centofante | |
| 6,162,089 | A | 12/2000 | Costello et al. | |
| 6,174,198 | B1 | 1/2001 | Wu et al. | |
| 6,176,737 | B1 * | 1/2001 | Choy | 439/541.5 |
| 6,183,292 | B1 | 2/2001 | Chen et al. | |
| 6,250,965 | B1 | 6/2001 | Neifer | |
| 6,261,128 | B1 | 7/2001 | Heim et al. | |
| 6,315,615 | B1 | 11/2001 | Raistrick | 439/637 |
| 6,328,605 | B1 | 12/2001 | Walker et al. | |

FOREIGN PATENT DOCUMENTS

| | | |
|---|---|---|
| JP | 47-41714 | 10/1972 |
| JP | 50-56987 | 9/1975 |
| JP | 61-118980 | 6/1986 |
| JP | 06-036834 | 2/1994 |
| JP | 6-77178 | 10/1994 |
| JP | 08-236187 | 9/1996 |
| JP | 09-027367 | 1/1997 |
| JP | 11-111402 | 4/1999 |
| JP | 2000-502490 | 2/2000 |
| JP | 2000-251024 | 9/2000 |
| JP | 2000-251025 | 9/2000 |
| JP | 2002-117945 | 4/2002 |
| JP | 2002-124343 | 4/2002 |

OTHER PUBLICATIONS

U.S. application Ser. No. 09/706,786, Ito et al., filed Nov. 7, 2000.

(List continued on next page.)

*Primary Examiner*—Tho D. Ta
(74) *Attorney, Agent, or Firm*—Finnegan, Henderson, Farabow, Garrett & Dunner, LLP

(57) ABSTRACT

There is provided a card connector for easily achieving appropriate layout of contact terminals corresponding to contact pad positions of two types of card while reducing packaging space and soldering work and repair work. Respective slots for the two types of card are disposed at upper and lower positions. Apart of second contact terminals 50 for a second card are disposed so as to be in reverse in press-fit direction to other second contact terminals 50 and first contact terminals 40 for a first card.

6 Claims, 13 Drawing Sheets

OTHER PUBLICATIONS

U.S. application Ser. No. 09/777,892, Saito et al., filed Feb. 7, 2001.
U.S. application Ser. No. 09/842,083, Nishimura, filed Apr. 26, 2001.
U.S. application Ser. No. 09/922,866, Ito et al., filed Aug. 7, 2001.
U.S. application Ser. No. 09/978,664, Sato, filed Oct. 18, 2001.
U.S. application Ser. No. 10/057,944, Mithuhashi et al., filed Jan. 29, 2002.
U.S. application Ser. No. 10/067,891, Ito et al., filed Feb. 8, 2002.
U.S. application Ser. No. 10/090,800, Takeyama et al., filed Mar. 6, 2002.
U.S. application Ser. No. 10/046,716, Ooya, no filing date.
Japanese Office Action dated Jan. 21, 2003 and English Translation.
Japanese Office Action dated Jan. 24, 2003 and English Translation.
PCT International Search Report dated Feb. 7, 1997.

* cited by examiner

MULTI-CARD CARD CONNECTOR FOR MULTI-TYPE CARDS

This application is based on Patent Application No. 2000-128489 filed Apr. 27, 2000 in Japan, the content of which is incorporated hereinto by reference.

BACKGROUND OF THE INVENTION

1. Field of the Invention

The present invention relates to a card connector mounted to electronic appliances such as portable telephones, telephones, PDA (personal digital assistance), portable audio, cameras and the like, more specifically to a card connector which can be loaded simultaneously with at least two cards of different types differing in outer shape, contact pad position or the like.

2. Description of Prior Art

In electronic appliances such as portable telephones, telephones, PDA, cameras and the like, various functional expansions are achieved by mounting IC cards such as SIM (subscriber identify module) card, MMC (multimedia card), smart media (trademark), SD (super density, secure digital) card, memory stick (trademark) and the like, which are incorporated with ICs such as memories or the like.

In a connector structure for detachably mounting such IC cards, a plurality of contact terminals which are connected with various signal processing circuits and a power supply circuit at the electronic appliance side mounted with the connector are provided in a connector housing, and these plurality of contact terminals are contacted with a plurality of contact pads formed on the front or backside of the mounted IC card, so that the IC card is electrically connected through these contact terminals with the electronic appliances mounting the connector.

As described above, IC cards of this kind include various cards differing in outer shape or contact pad position. However, recently, a card connector is in demand that can be loaded with cards of a plurality of different types simultaneously so that the electronic appliances can be operative with cards of a plurality of types.

For example, when considering a card connector which is possible to be loaded with two types of card, as one construction thereof, a card slot is constructed so that two types of card arranged side by side can be inserted.

However, when cards are arranged side by side, connector area occupying on the board is increased to interfere with downsizing of the electronic appliance.

Furthermore, as another configuration of connector capable of loading with two types of card, a technique is considered in which the card slot is constructed so that cards can be inserted in a positional relation of upper lower sides.

In this case, however, when respective contact terminals for two types of card are arranged so that the respective contact terminals are pressed into and fixed in a same direction (for example, contact terminals are pressed from a card rear surface wall side to a card ejection direction), soldered portions of respective contact terminals are concentrated to one of rear surface side or front surface side of the card housing. Therefore, these soldered portions tend to be interfered with each other, and the layout thereof becomes very difficult.

That is, in this type of card connector, the plurality of contact terminals are required to be arranged so that soldered portions fixed to the printed circuit board are disposed in a single line with an appropriate pitch for subsequent repair (soldered portion is peeled off using an electric soldering copper), image recognition of the board implemented or for image inspection of the soldered portions. When the soldered portions are arranged in two rows, the outside soldered portions are accessed by the electric soldering copper, however, the inside soldered portions are not accessible by the electric soldering copper. To dispose soldered portions of a plurality of contact terminals in a line, it is necessary to arrange soldered portions of contact terminals for one card between pitches of soldered portions of the other card, when the pitch is small in width, the arrangement thereof becomes substantially impossible.

Furthermore, as described above, in each of this type of card, contact pad pitches are naturally different from each other. Therefore, in order to arrange in a line the respective soldered portions of respective cards of different pad pitches, it is necessary to devise a complex shape of soldered portions of contact terminals, which poses a problem of difficulty in manufacture.

The present invention has been made in consideration of the above circumstances. The object of the present invention is to provide a card connector which is capable of containing two or more types of card differing in outer shape or contact pad position. And the object of the present invention is to provide the card connector, in which the contact terminals can easily be arranged in an appropriate layout corresponding to the layout of the contact pads of the respective cards while reducing the connector area occupying on the board, and soldering work, servicing work and the like can easily be carried out.

SUMMARY OF THE INVENTION

According to an one aspect of the present invention, a card connector capable of containing at least two types of first and second cards differing in outer shape and contact pad position, comprises a connector housing having a upper slot for containing the first card and a lower slot for containing the second card, a plurality of first contact terminals corresponding to contact pads for the first card, and a plurality of second contact terminals corresponding to contact pads for the second card, wherein each soldered portion of the first contact terminal is disposed at a rear surface side of the connector housing, and for soldered portions of the second contact terminals, part thereof are disposed at the same rear surface side of soldered portions of the first contact terminals, and remnants thereof are all disposed at a front surface side of the connector housing so as to be in reverse direction to the first contact terminals.

According to the present invention, respective slots for two types of card are disposed in upper and lower sides, so that part of second contact terminals for the second card are opposite in insertion direction to the other second contact terminals and first contact terminals for the first card. Therefore, even if the respective slots for two types of card are disposed in upper and lower sides, respective soldered parts of the first and second contact terminals will not interfere with one another, and the respective soldered parts can easily be arranged each in a single line. Further, contact terminals can easily be arranged in an appropriate layout corresponding to the layout of the contact pad of the second card while reducing the connector area occupying on the board.

The above and other objects, features and advantages of the present invention will become more apparent from the following description of embodiments thereof taken in conjunction with the accompanying drawings.

DESCRIPTION OF THE PREFERRED EMBODIMENT

In the following, an embodiment of the present invention will be described in detail with reference to the accompanying drawings.

First, two types of card will be described which can be loaded on the card connector of the embodiment shown below.

Figure 1:
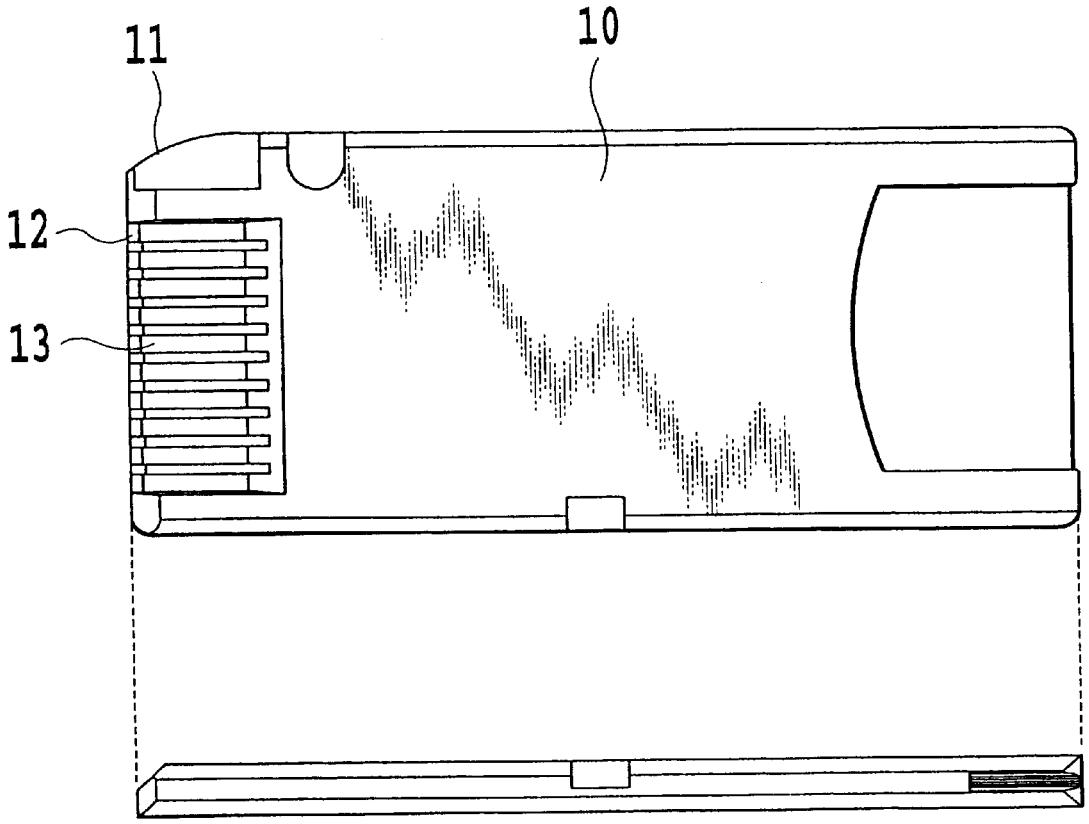
FIG. 1 is a perspective diagram exemplifying a narrow type card.

FIG. 1 shows the outer appearance of contact pad surface and side surface of a memory stick (trademark) as an example of a narrow type card 10.

The narrow type card 10 has a chamfered portion 11 for mis-insertion prevention at its tip edge portion. At the tip side of the card main body 10, a plurality of recesses 12 are formed, and respective contact pads 13 are disposed on the bottom surfaces of these recesses 12. The contact pads 13 employ a 10-pin type.

Figure 2:
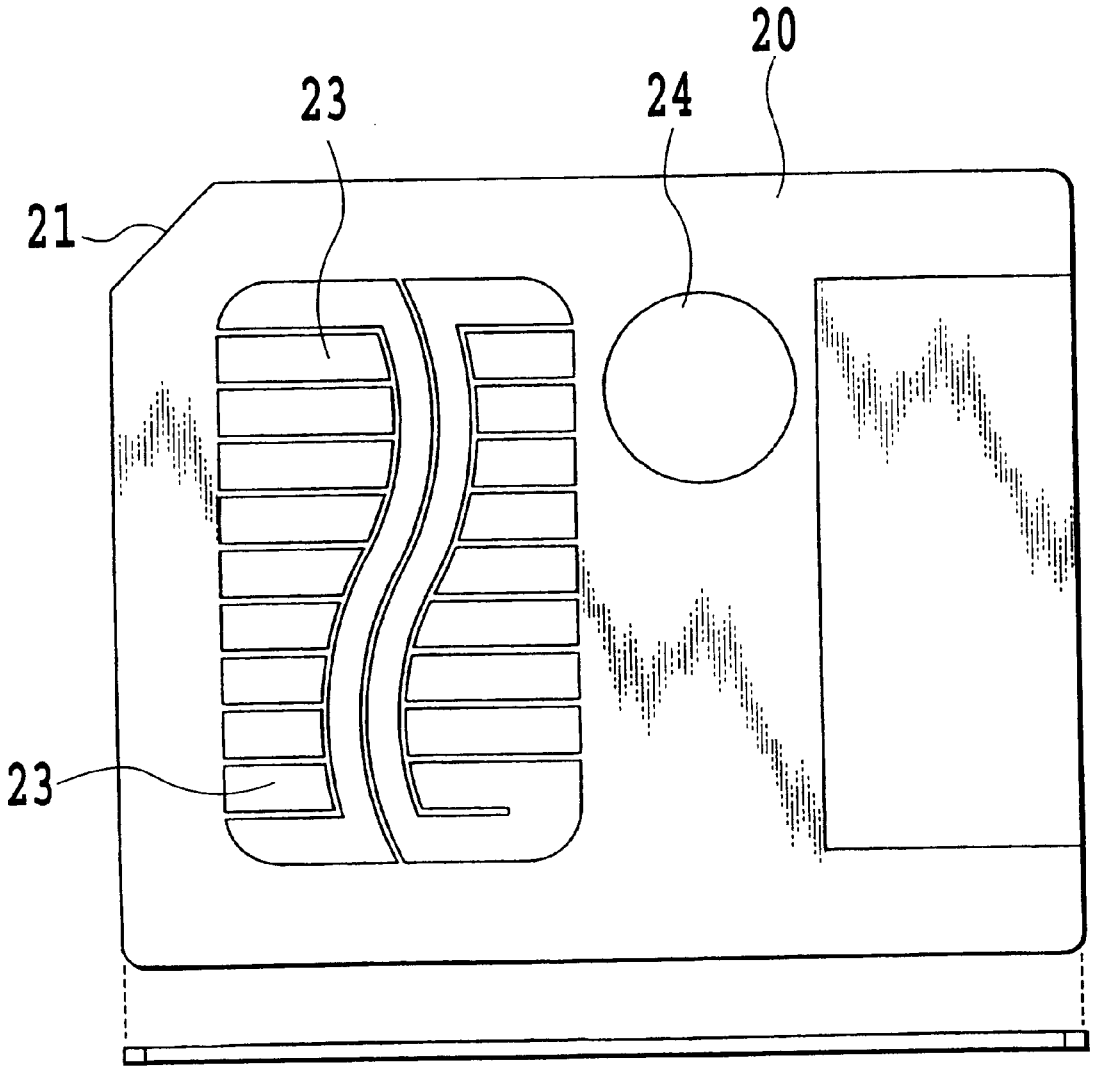
FIG. 2 is a perspective diagram exemplifying a thin and wide type card.

FIG. 2 shows the outer appearance of contact pad surface and side surface of a smart media (trademark) as an example of a thin and wide type card 20.

The thin and wide type card 20 is larger in plane size but smaller in thickness compared to the narrow type card 10. At one edge portion of the tip of the card 20, a chamfered part 21 for mis-insertion prevention is formed. At the tip side of the card 20, a contact area provided with a plurality of contact pads 23, which are arranged in two rows, is disposed. Reference numeral 24 denotes a write protect pad for mis-erase prevention. As described above, as compared with the narrow type card 10, the thin and wide type card 20 is quite different in its outer shape, plane size, thickness, and contact pad position.

Next, an embodiment of the card connector according to the present invention will be described with reference to FIGS. 3 to 13.

Figure 3:
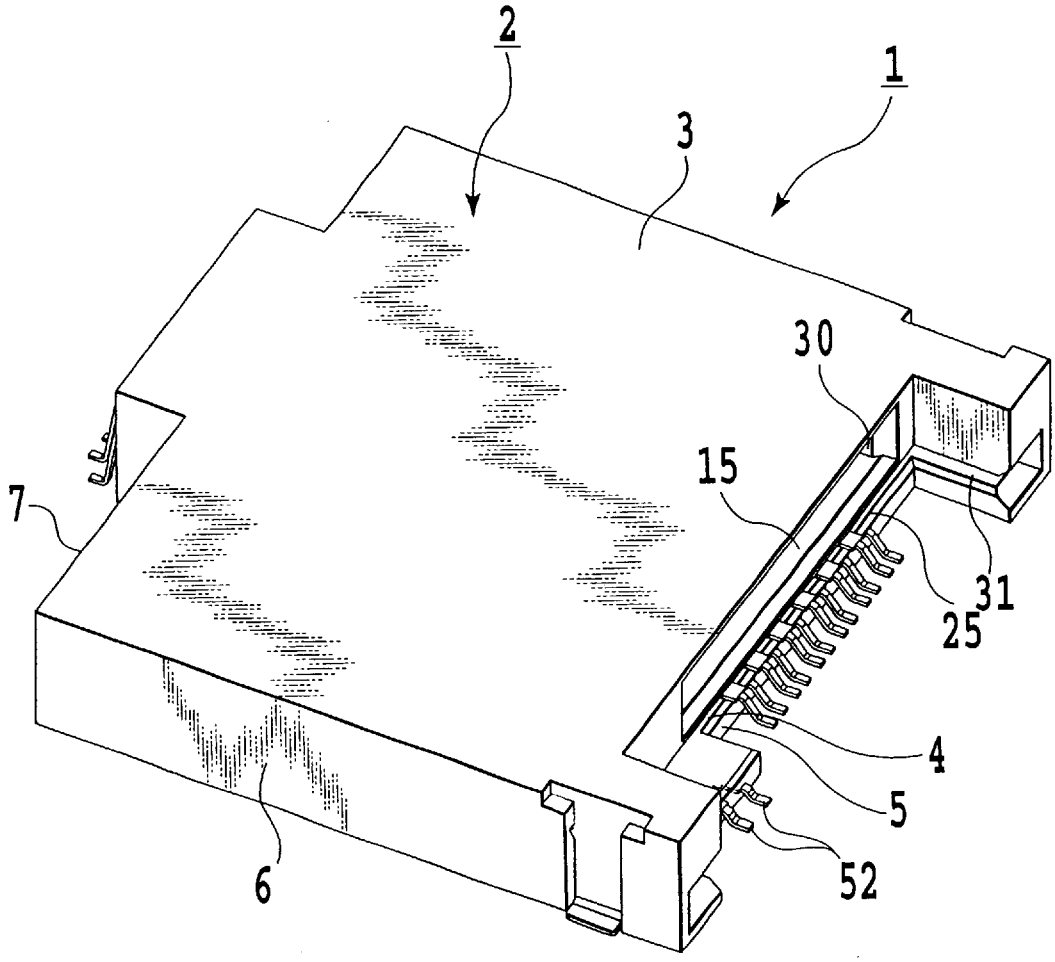
FIG. 3 is a perspective diagram showing the outer construction of an embodiment of the card connector according to the present invention.
Figure 4:
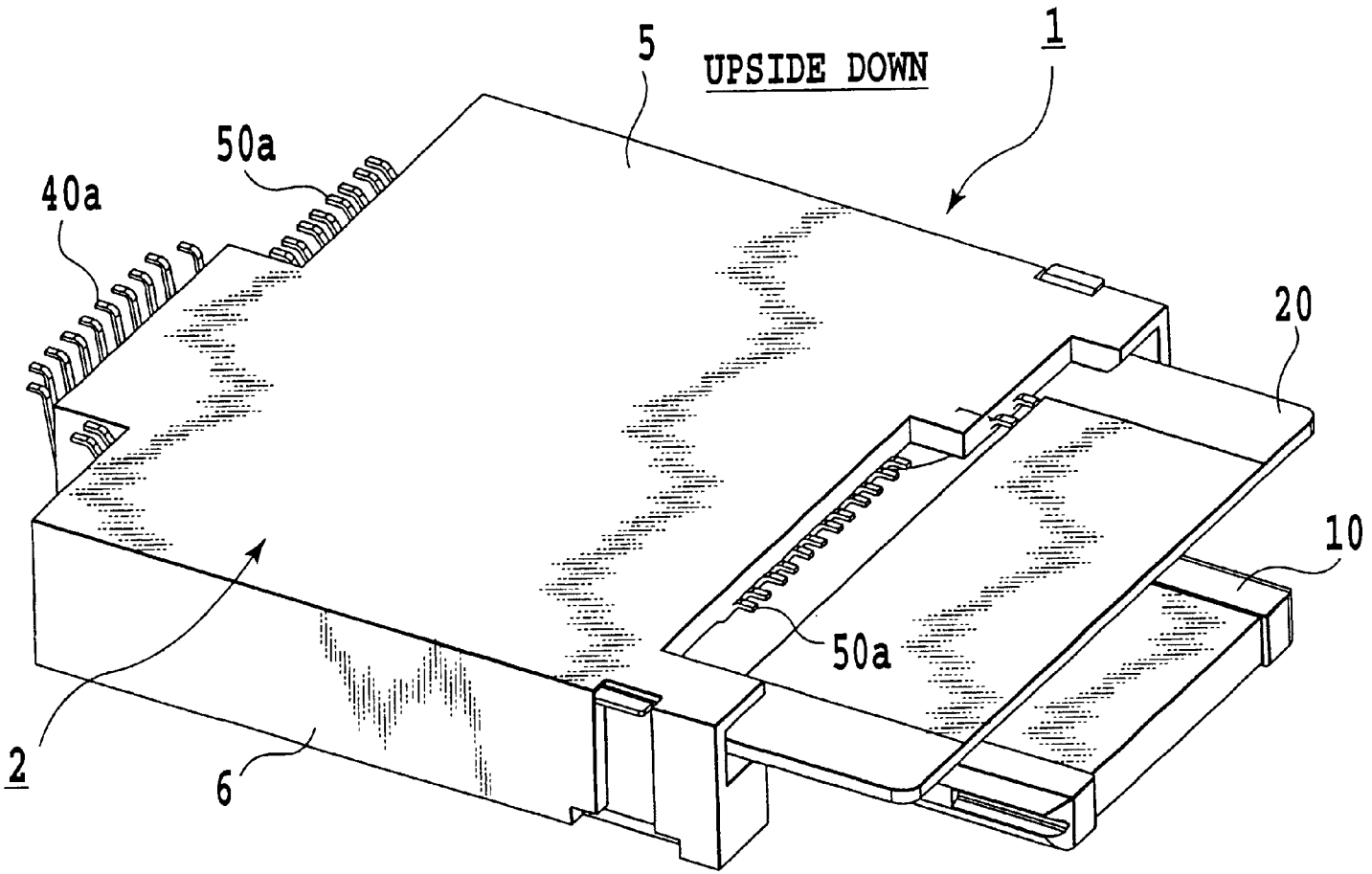
FIG. 4 is a perspective diagram showing the outer construction, shown upside down, of the embodiment of the card connector according to the present invention.
Figure 5:
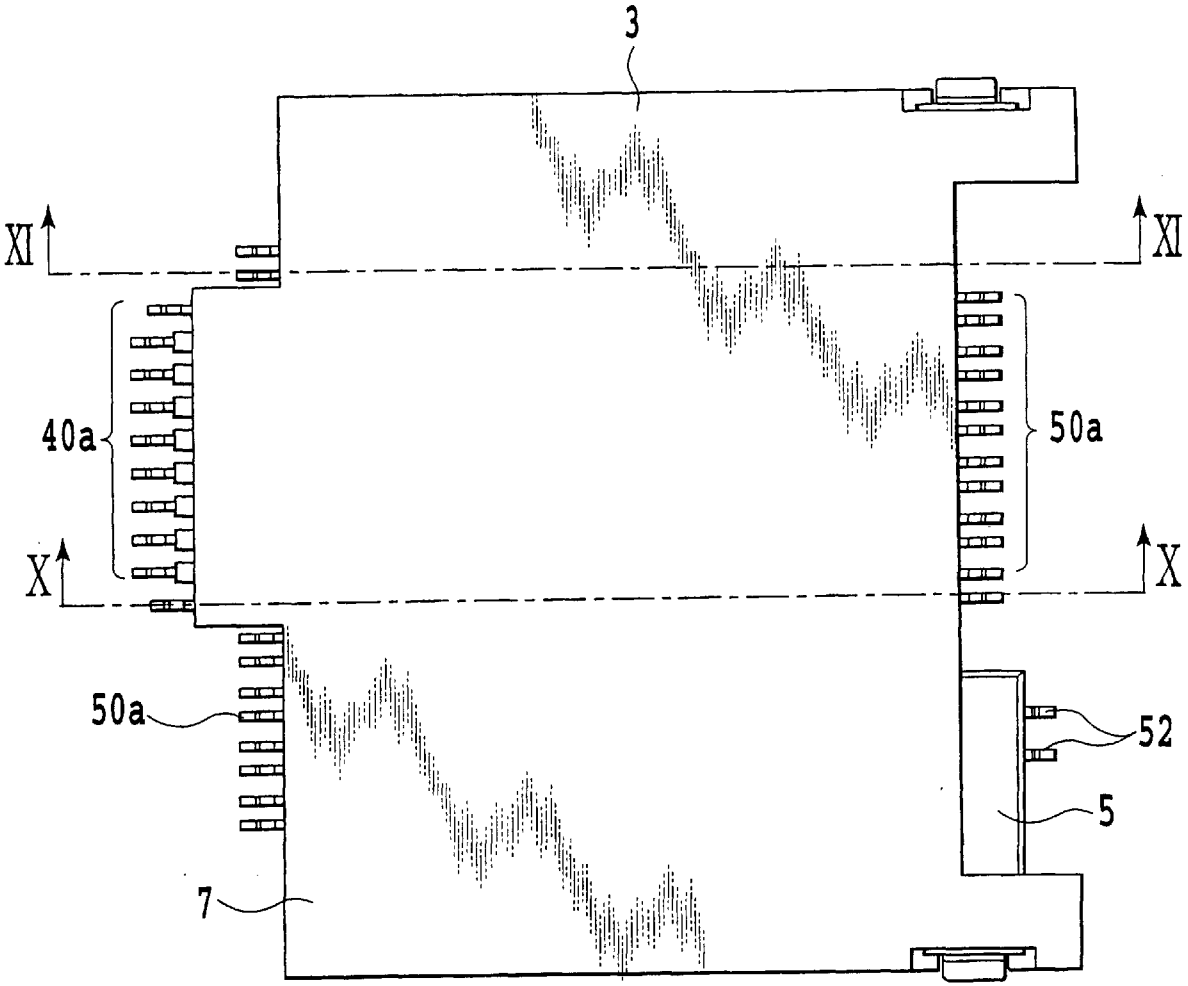
FIG. 5 is a plane diagram showing the embodiment of the card connector according to the present invention.
Figure 6:
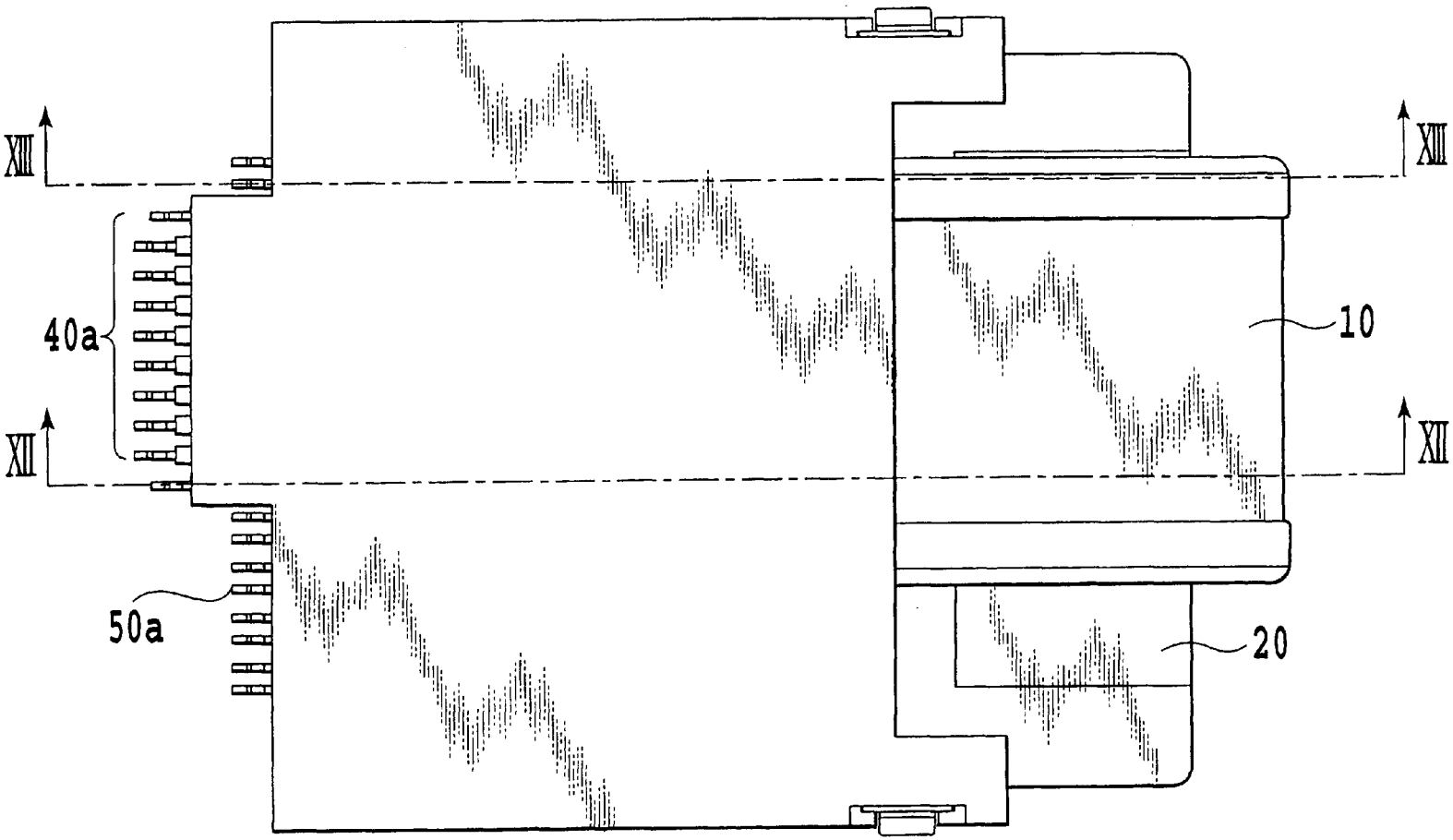
FIG. 6 is a plane diagram showing the embodiment of the card connector, how cards are inserted, according to the present invention.
Figure 7:
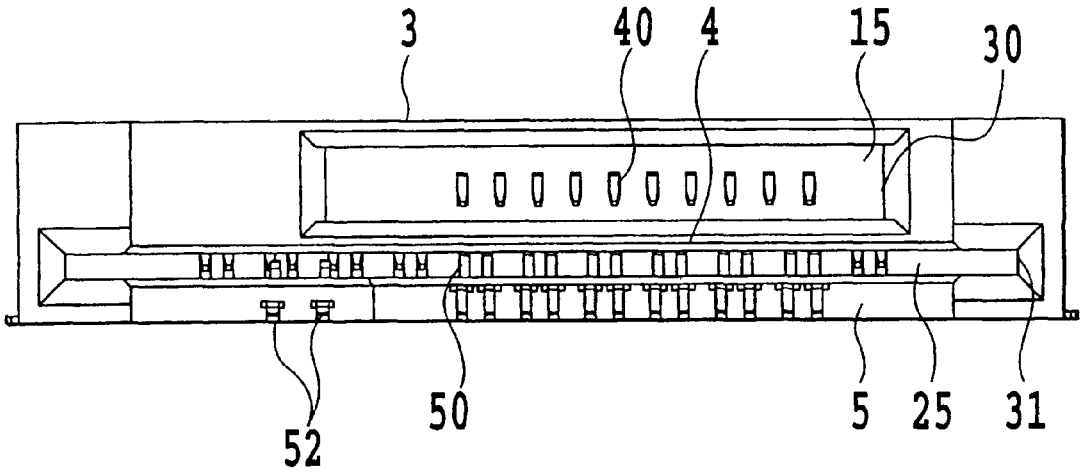
FIG. 7 is a front diagram showing the embodiment of the card connector according to the present invention.
Figure 8:
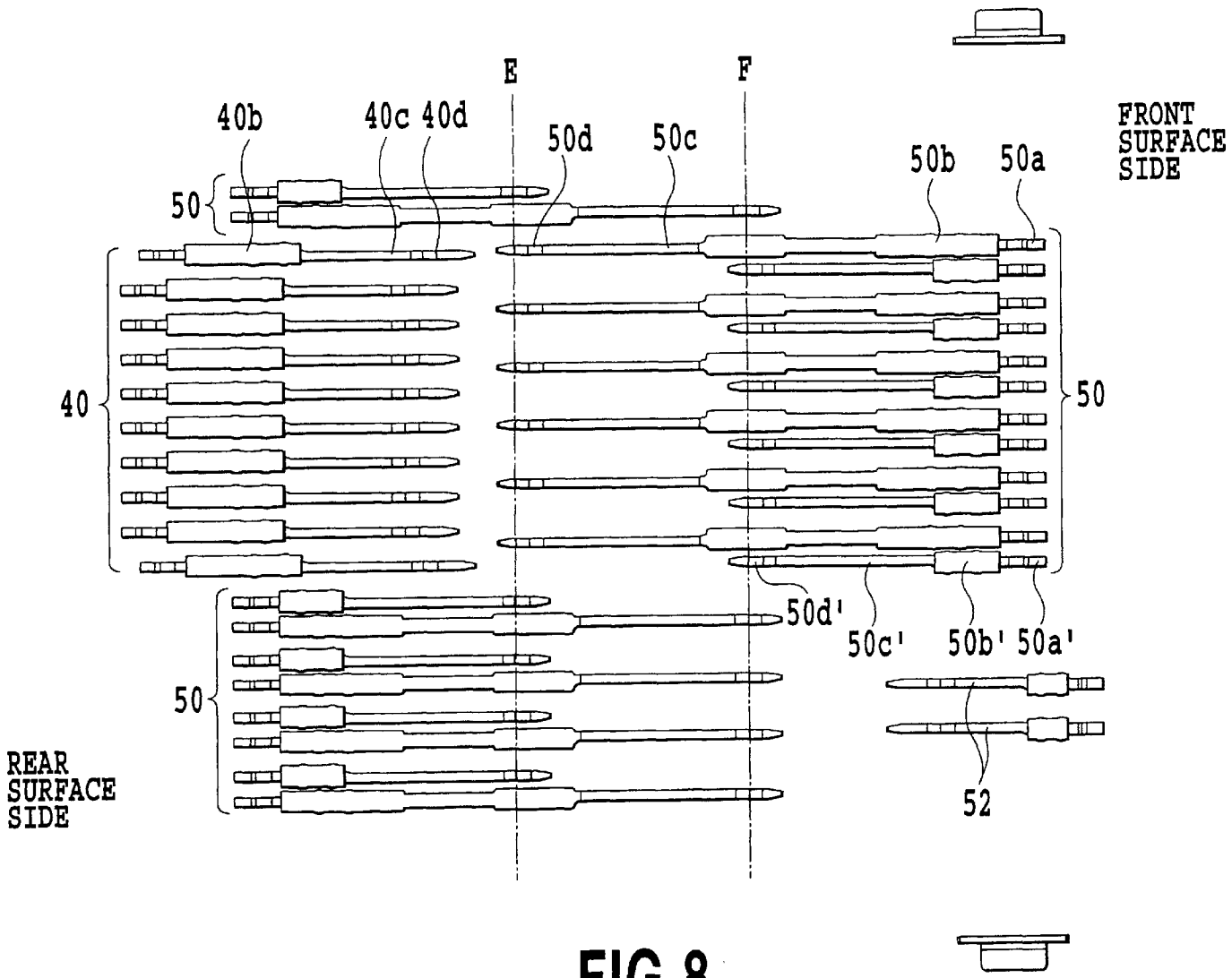
FIG. 8 is a plane diagram showing arrangement of contact terminals for both cards.
Figure 9:
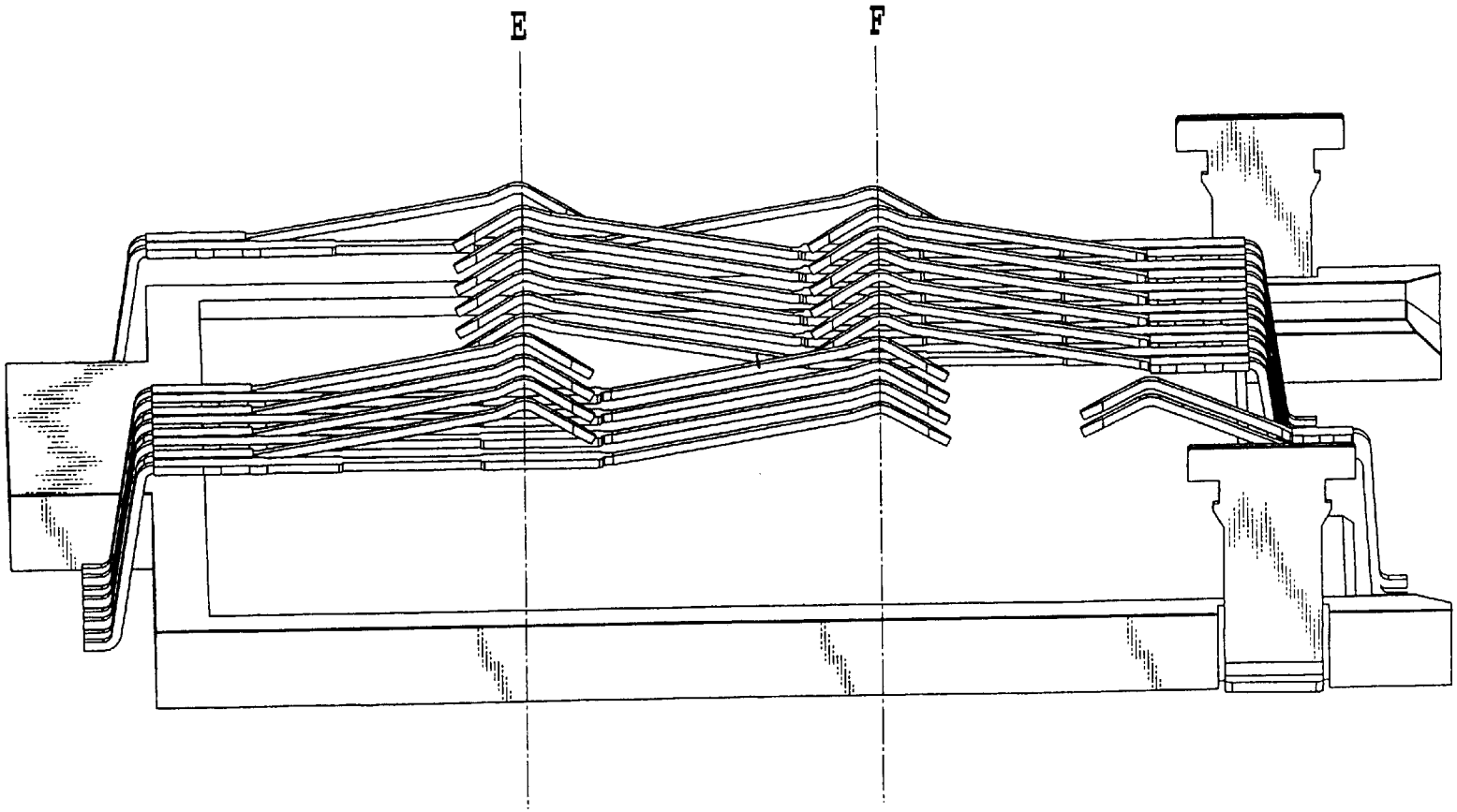
FIG. 9 is a perspective diagram showing arrangement of contact terminals for a thin and wide type card.
Figure 10:
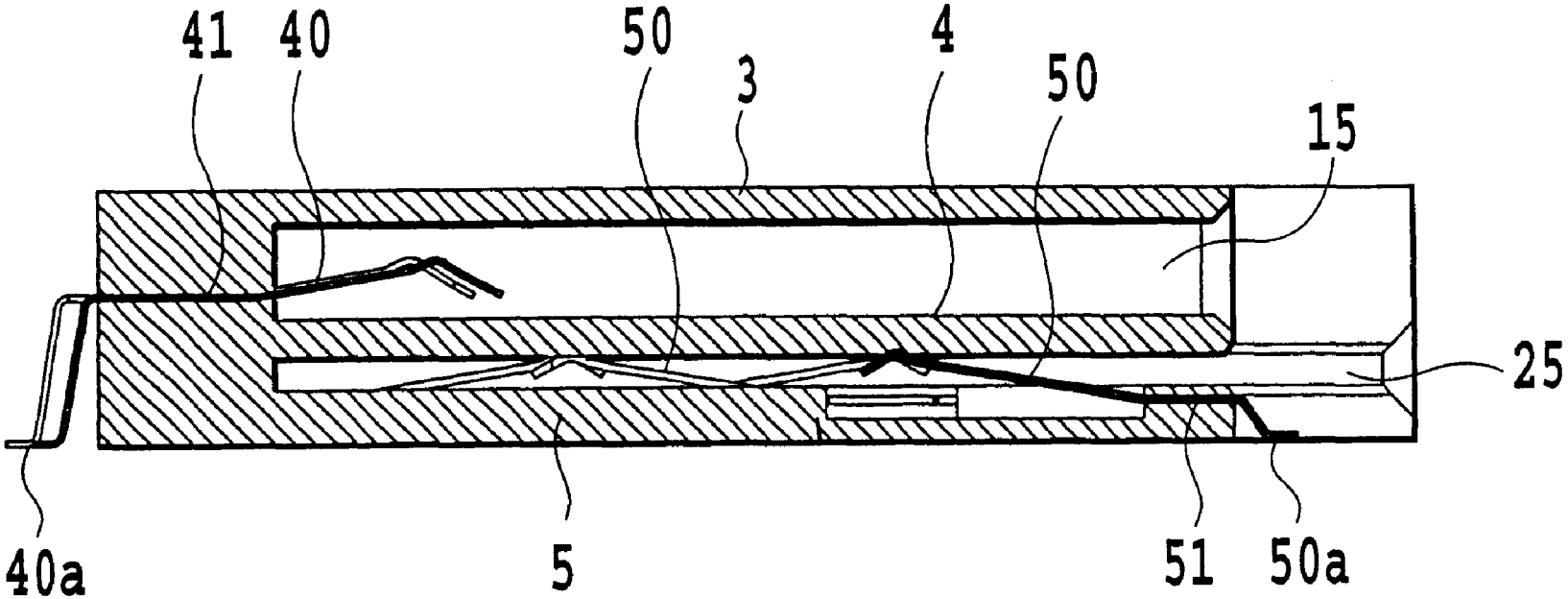
FIG. 10 is a sectional diagram taken along line X—X of FIG. 5.
Figure 11:
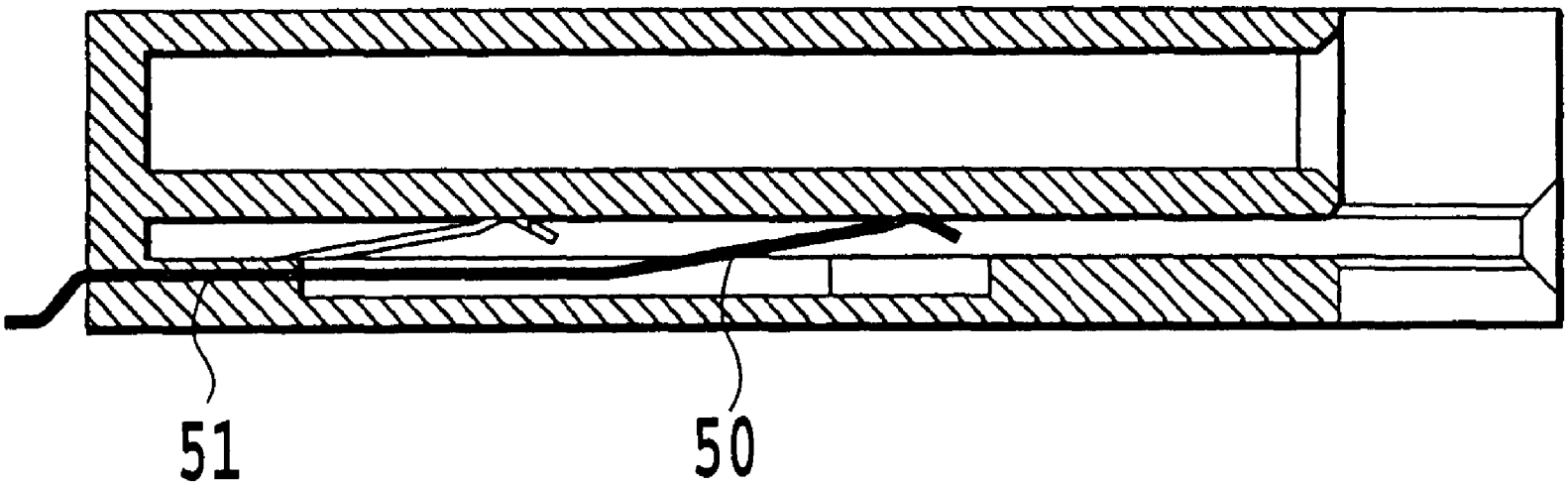
FIG. 11 is a sectional diagram taken along line XI—XI of FIG. 5.
Figure 12:
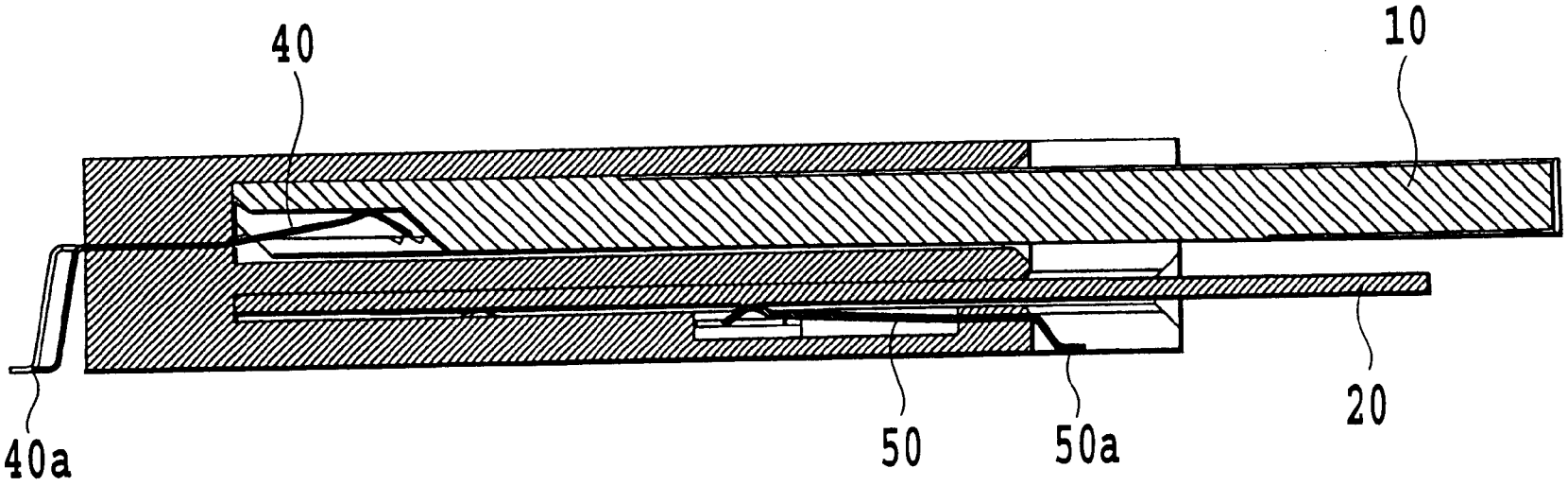
FIG. 12 is a sectional diagram taken along line XII—XII of FIG. 6.
Figure 13:
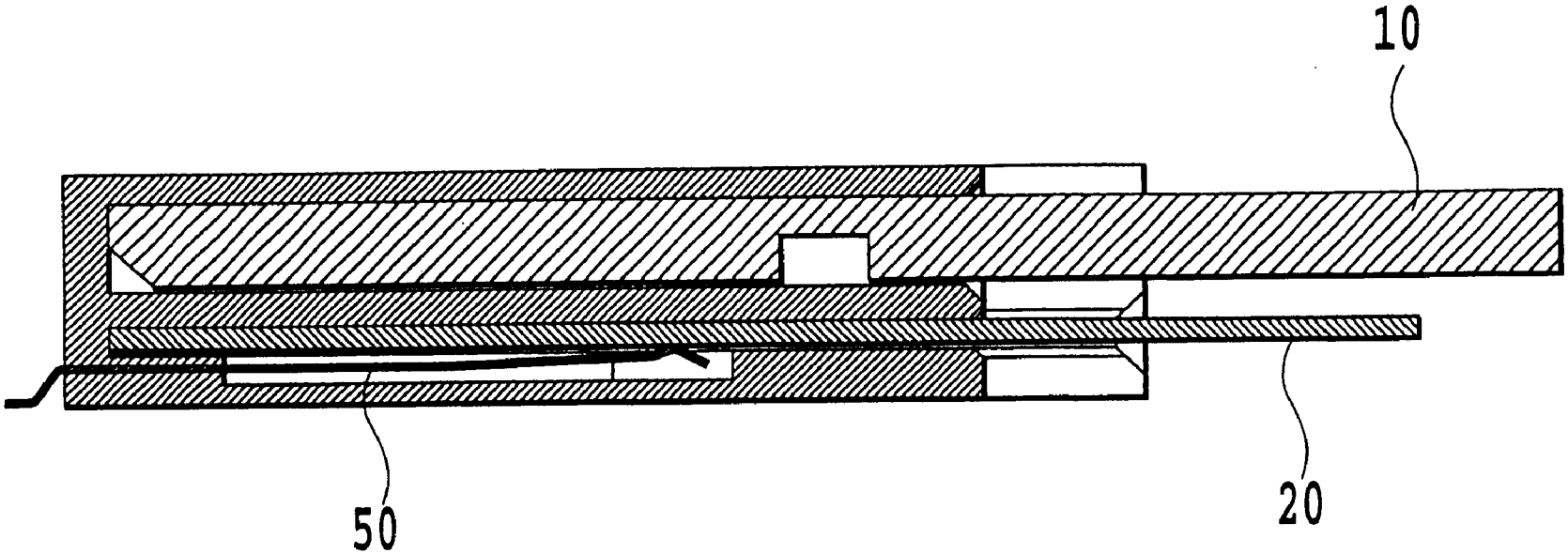
FIG. 13 is a sectional diagram taken along line XIII—XIII of FIG. 6.

FIG. 3 is a perspective diagram showing the outer appearance of a card connector 1 as viewed from the upper side. FIG. 4 is a perspective diagram showing the outer appearance of the card connector 1 how cards are inserted, shown in reverse, that is, upside down. FIG. 5 shows a plane diagram of the card connector 1. FIG. 6 shows a plane diagram of the card connector how cards are inserted. FIG. 7 is a front diagram showing the front surface side of the card connector 1. FIG. 8 is a plane diagram showing the arranged state of contact terminals for the two cards, with the card connector housing omitted. FIG. 9 is a perspective diagram showing arranged state of contact terminals for the thin and wide type card 20, with the upper plate and middle plate of the card connector housing omitted. FIG. 10 is a sectional diagram taken along line X—X of FIG. 5. FIG. 11 a sectional diagram taken along line XI—XI of FIG. 5, FIG. 12 is a sectional diagram taken along line XII—XII of FIG. 6, and FIG. 13 is a sectional diagram taken along line XIII—XIII of FIG. 6.

The card connector 1 shown in these figures is incorporated in electronic appliances such as portable telephones, PDA, portable audios, cameras and the like. The above-described narrow type card 10 and the thin and wide type card 20 are inserted in the connector 1 in a positional relation of upper and lower sides. In this case, the narrow type card 10 is inserted in an upper slot 15, and the thin and wide type card 20 in a lower slot 25.

The card connector 1 has a connector housing 2 molded from an insulator such as a resin material. The connector housing 2 comprises an upper plate 3, a middle plate 4, a lower plate 5, right and left side plates 6,6, a rear plate 7 and the like.

As shown in FIGS. 3 and 7, a card slot (lower slot) 25 is formed between the middle plate 4 and the lower plate 5 of the connector housing 2 for detachably mounting the thin and wide type card 20 in the connector. Further, between the middle plate 4 and the upper plate 3, a card slot (upper slot) 15 is formed for detachably mounting the narrow type card 10 in the connector.

On both sides of the upper slot 15, guide grooves 30 for guiding attachment and detachment of the narrow type card 10 are formed, and the narrow type card 10 is guided by the guide grooves 30 in the state with the contact pad surface facing down.

As shown in FIGS. 7 and 10, on the housing middle plate 4, a plurality of grooves 41 are formed for positioning and pressing thereinto the plurality (in this case, 10) of contact terminals 40 for the narrow type card 10.

Each contact terminal 40 comprises a cantilever contact spring. As shown in FIG. 8, the contact terminal 40 has a soldered portion 40*a* soldered to the contact pad of the printed circuit board of the electronic appliance, a fixing portion 40*b* for fixing in said groove 41, an elastically deformable contact spring 40*c*, and a contact portion 40*d* protruding upward and contacting with the contact pad 13 of the card 10.

The plurality of contact terminals 40 for the narrow type card 10 are pressed into through the rear surface side of the card housing 2 in the card insertion direction to be fixed into the groove 41 formed in the housing. That is, the respective soldered portions 40*a* of these contact terminals 40 are disposed at the rear surface side of the connector housing 2.

When the narrow type card 10 is inserted in the upper slot 15 in the state with the contact pad surface facing down, as shown in FIG. 12, respective contact pads 13 of the narrow type card 10 contact with the contact portions 40*d* of the respective contact terminals 40.

On both sides of the lower slot 25, on the other hand, guide grooves 31 for guiding attachment and detachment of the thin and wide type card 20 are formed. The thin and wide type card 20 is inserted along the guide grooves 31 in the state with the contact pad surface facing down.

As shown in FIG. 10 and FIG. 11, at the inside surface side of the housing lower plate 5, a plurality of grooves 51 are formed for positioning and pressing thereinto a plurality of contact terminals 50 for the thin and wide type card 20.

The respective contact terminals 50 for the thin and wide type card 20, as shown in FIGS. 8 and 9, comprise two types of long and short terminals, so that a short contact terminal is disposed between arrangement pitches of the long contact terminal. The respective contact terminals 50, as shown in FIG. 8, comprise cantilever contact springs. The contact terminals 50 have soldered portions 50*a* and 50*a*' (short one is indicated by ') soldered to the contact pads of the printed circuit board of the electronic appliance, fixing portions 50*b* and 50*b*' for fixing in the grooves 51, elastically deformable contact springs 50*c* and 50*c*', and contact portions 50*d* and 50*d*' protruding upward and contacting with the contact pads 23 of the thin and wide type card 20.

Further, the respective contact portions 50*d* and 50*d*' of the respective contact terminals 50 are arranged on two rows of straight lines E and F so as to correspond to the locations of the two rows of contact pads 23 of the thin and wide type card 20.

In making such arrangement, these contact terminals are disposed so that the contact portions 50*a* of some longer contact terminals where the soldered portions 50*a* thereof are positioned at the front surface side of the connector housing and the respective contact portions 50*a*' of some shorter contact terminals where the soldered portions 50*a*' are positioned at the rear surface side of the connector housing are positioned on one straight line E which extends in the card width direction. Further, these contact terminals are disposed so that the contact portions 50*a* of some longer contact terminals where the soldered portions 50*a*' thereof are positioned at the rear surface side of the connector housing and the respective contact portions 50*a*' of some shorter contact terminals where the soldered portions 50*a*' are positioned at the front surface side of the connector housing are positioned on the other straight line F which extends in the card width direction.

As described above, there are two types in the plurality of contact terminals 50 for the thin and wide type card 20 that one is of a type which is pressed into in the card detachment direction through the rear surface side of the connector housing 2, and another is of a type which is pressed into in the card insertion direction through the front surface side of the connector housing 2.

When the thin and wide type card 20 in the state with the contact pad surface facing down is inserted in the lower slot 25, the respective contact pads 23 of the thin and wide type card 20 contact with contact portions 50*d* and 50*d*' of the respective contact terminals 50.

Two contact terminals 52 for detecting the presence of a write protect pad 24 of the thin and wide type card 20 are provided on the housing lower plate 5.

As described above, in the present embodiment, the slots 15 and 25 for the two types of card are disposed at the upper and lower sides, and part of the contact terminals 50 for the thin and wide type card 20 composed of two types of long and short are in reverse in press-fit direction to the contact terminals for other than that part and for the narrow type card. Therefore, even if the slots 15 and 25 for these two types of cards 10 and 20 are disposed at the upper and lower sides, the respective soldered portions 40*a* and 50*a* of the respective contact terminals 40 and 50 are appropriately dispersed. Thereby, the soldered portions 40*a* and 50*a* of the contact terminals 40 and 50 for the two types of card do not interfere with each other, and the respective soldered portions 40*a* and 50*a* can be easily arranged in respective lines. Therefore, pressing into operation of the respective contact terminals becomes easy, image recognition of the soldered portions when the board is implemented and image inspection of the soldered portion become easy, and repair work using an electric soldering copper becomes easy.

Further, in the above embodiment, the respective contact terminals are arranged in opposition to each other so that contact parts 50*d* of the plurality of contact terminals of the two types of long and short are in line on the two straight lines E and F. Therefore, appropriate layout of the contact terminals corresponding to the specifications of the contact pads 23 of the thin and wide type card 20 can be easily achieved while reducing the packaging space of the connector.

Still further, in the above embodiment, the narrow type card 10 is inserted in the upper slot 15 and the thin and wide type card 20 in the lower slot 25, however, alternatively, this positional relation may be reversed.

Further, in the above embodiment, memory stick is used as an example of the narrow type card 10, and smart media as an example of the thin and wide type card 20, however, the present invention may be applied to any other types of card.

As described above, in the present invention, since the slots for the two types of card are disposed at the upper and lower sides, and part of the contact terminals for one card are disposed to be in reverse in press-fit direction to other contact terminals, the occupying area of the connector can be reduced, the soldered portions of the contact terminals for the two types of card do not interfere with each other, and the respective soldered portions can be easily arranged in respective lines. Therefore, pressing into operation of the respective contact terminals becomes easy, image recognition of the soldered portions when the board is implemented and image inspection of the soldered portion become easy, and repair work using an electric soldering copper becomes easy.

Yet further, since the respective contact portions of the plurality of contact terminals composed of two types of long and short are disposed in opposition to each other so that the contact portions are in line with two parallel lines extending in the card width direction, the connector packaging space can be reduced and appropriate layout of contact terminals corresponding to the contact pad layout of the predetermined cards can be easily achieved.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

What is claimed is:

1. A multi-card connector for multi-type cards capable of containing at least two types of first and second cards differing in outer shape and contact pad position, comprising:

a connector housing having an upper slot for containing said first card and a lower slot for containing said second card;

a plurality of first contact terminals corresponding to contact pads for said first card; and a plurality of second contact terminals corresponding to contact pads for said second card, wherein each soldered portion of said first contact terminal is disposed at a rear surface side of said connector housing; and for soldered portions of said second contact terminals, a first set thereof is disposed at the same rear surface side of soldered portions of said first contact terminals, and remnants thereof are all disposed at a front surface side of said connector housing so as to be in reverse direction to said first contact terminals.

2. A multi-card connector for multi-type cards capable of containing at least two types of first and second cards differing in outer shape and contact pad position, comprising:

a connector housing having an upper slot for containing said first card and a lower slot for containing said second card;

a plurality of first contact terminals corresponding to contact pads for said first card; and a plurality of second contact terminals corresponding to contact pads for said second card, wherein each soldered portion of said first contact terminal is disposed at a rear surface side of said connector housing;

for soldered portions of said second contact terminals, parts thereof are disposed at the same rear surface side of soldered portions of said first contact terminals, and remnants thereof are all disposed at a front surface side of said connector housing so as to be in reverse direction to said first contact terminals; and wherein contact portions of said second contact terminals of which soldered portions are positioned at front surface side of said connector housing and contact portions of said second contact terminals of which soldered portions are positioned at a rear surface side are disposed almost on a straight line along a card width direction.

3. The multi-card card connector as claimed in claim 2, wherein said second contact terminals are formed of two types of long and short;

respective contact portions of long contact terminals of which soldered portions are positioned at a front surface side of said connector housing and short contact terminals of which soldered portions are positioned at a rear surface side of said connector housing are disposed on a first straight line extending in a card width direction; and respective contact portions of short contact terminals of which soldered portions are positioned at a front surface side of said connector housing and long contact terminals of which soldered portions are positioned at a rear surface side of said connector housing are disposed on a second straight line extending in a card width direction.

4. A multi-card card connector for multi-type cards capable of containing at least two types of first and second cards differing in outer shape and contact pad position, comprising:

a connector housing having a lower slot for containing said first card and an upper slot for containing said second card;

a plurality of first contact terminals corresponding to contact pads for said first card; and a plurality of second contact terminals corresponding to contact pads for said second card, wherein each soldered portion of said first contact terminal is disposed at a front surface side of said connector housing; and for soldered portions of said second contact terminals, a first set thereof is disposed at the same front surface side of soldered portions of said first contact terminals, and remnants thereof are all disposed at a rear surface side of said connector housing so as to be in reverse direction to said first contact terminals.

5. A multi-card connector for multi-type cards capable of containing at least two types of first and second cards differing in outer shape and contact pad position, comprising:

a connector housing having a lower slot for containing said first card and an upper slot for containing said second card;

a plurality of first contact terminals corresponding to contact pads for said first card; and a plurality of second contact terminals corresponding to contact pads for said second card, wherein each soldered portion of said first contact terminal is disposed at a front surface side of said connector housing;

for soldered portions of said second contact terminals, parts thereof are disposed at the same front surface side of soldered portions of said first contact terminals, and remnants thereof are all disposed at a rear surface side of said connector housing so as to be in reverse direction to said first contact terminals; and wherein contact portions of said second contact terminals of which soldered portions are positioned at front surface side of said connector housing and contact portions of said second contact terminals of which soldered portions are positioned at a rear surface side are disposed almost on a straight line along a card width direction.

6. A multi-card card connector as claimed in claim 5, wherein said second contact terminals are formed of two types of long and short;

respective contact portions of long contact terminals of which soldered portions are positioned at a front surface side of said connector housing and short contact terminals of which soldered portions are positioned at a rear surface side of said connector housing are disposed on a first straight line extending in a card width direction, and respective contact portions of short contact terminals of which soldered portions are positioned at a front surface side of said connector housing and long contact terminals of which soldered portions are positioned at a rear surface side connector housing are disposed on a second straight line extending in a card width direction.

* * * * *